US005812676A

United States Patent [19]

Johnson, Jr.

[11] Patent Number: 5,812,676

[45] Date of Patent: Sep. 22, 1998

[54] NEAR-FIELD REPRODUCTION OF BINAURALLY ENCODED SIGNALS

[75] Inventor: Edwin C. Johnson, Jr., Norfolk, Mass.

[73] Assignee: Bose Corporation, Framingham, Mass.

[21] Appl. No.: 251,482

[22] Filed: May 31, 1994

[51] Int. Cl.[6] ..... H04R 5/00

[52] U.S. Cl. ..... 381/24; 381/26; 381/205

[58] Field of Search ..... 381/24, 25, 6, 381/216, 90, 189, 187, 182, 150, 153, 72.4, 205; 455/350, 351

[56] References Cited

U.S. PATENT DOCUMENTS

| | | | |
|---|---|---|---|
| 3,236,949 | 2/1966 | Atal et al. . | |
| 3,870,834 | 3/1975 | Yeaple | 381/24 |
| 3,943,572 | 3/1976 | Aileo | 381/189 |
| 4,070,546 | 1/1978 | Hiruta . | |
| 4,075,438 | 2/1978 | Kappel | 381/24 |
| 4,199,657 | 4/1980 | Lane | 381/24 |
| 4,388,492 | 6/1983 | Sato . | |
| 4,893,342 | 1/1990 | Cooper et al. . | |
| 4,975,974 | 12/1990 | Nishijima et al. . | |
| 5,201,003 | 4/1993 | Pavel | 381/25 |
| 5,208,867 | 5/1993 | Stites | 381/72 |
| 5,287,576 | 2/1994 | Fraser . | |
| 5,684,879 | 11/1997 | Verdick | 381/24 |

FOREIGN PATENT DOCUMENTS

| | | | |
|---|---|---|---|
| A-421681 | 10/1991 | European Pat. Off. . | |
| A-3214080 | 10/1983 | Germany . | |
| 0023601 | 3/1978 | Japan | 381/25 |
| A-1069539 | 5/1967 | United Kingdom . | |

OTHER PUBLICATIONS

Henrik Moller, Reproduction of Artificial–Head Recordings through Loudspeakers, Jan. 1989, Journal of Audio Engineering Society, pp. 30–33.

European Patent Office Search report dated Nov. 7, 1996.

M.R. Schroeder et al., Comparative study of European concert halls: correlation of subjective preference with geometric and acoustic parameters, Oct. 1974, J.Acoust.Soc. Am., vol. 56, No. 4.

Henrik Moller, Reproduction of Artificial Head Recordings through Loudspeakers, 1989 Jan./Feb., J. Audio Eng. Soc., vol. 37, No. 1/2.

David Griesinger, Theory and Design of a Digital Audio Signal Processor for Home Use, 1989 Jan./Feb., J. Audio Eng. Soc., vol. 37, No. 1/2.

Duane H. Cooper et al., Prospects for Transaural Recording, 1989 Jan./Feb., J. Audio Eng. Soc., vol. 37, No. 1/2.

Tomas Salava, Transaural Stereo and Near–Field Listening, 1990 Jan./Feb., J. Audio Eng. Soc., vol. 38, No. 1/2.

Jerry Bauck et al., Generalized Transaural Stereo, 1992 Oct. 1–4, AES Convention, San Francisco.

William M. Bulkeley, Sound Program Lets User Mimic Site's Acoustics, Oct. 19, 1994, The Wall Street.

*Primary Examiner*—Curtis A. Kuntz
*Assistant Examiner*—Xu Mei
*Attorney, Agent, or Firm*—Fish & Richardson

[57] ABSTRACT

A transportable sound reproduction system for transducing binaurally encoded signals with near-field reproduction including a support, a head locator attached to the support for positioning a listener's head at a desired location in the near-field, and a pair of speakers located close to and forward of the desired location of the listener's head. A carrying case for transporting the system has protective packaging with compartments for detachably securing the components of the system.

13 Claims, 8 Drawing Sheets

NEAR-FIELD REPRODUCTION OF BINAURALLY ENCODED SIGNALS

The present invention relates in general to sound reproduction systems for transducing binaurally encoded signals and more particularly concerns novel apparatus for transducing binaurally encoded signals with near-field reproduction, including signals incorporating transaural crosstalk equalization.

It is the aim of such systems to reproduce for the listener a fully realistic, three dimensional auditory illusion that is indistinguishable from the listening experience received when the listener is present in the actual sound field that the system is emulating.

For background reference is made to U.S. Pat. No. 4,893,342 entitled HEAD DIFFRACTION COMPENSATED STEREO SYSTEM and a paper of David Griesinger entitled "Theory and Design of a Digital Audio Signal Processor for Home Use" in J. Audio Eng. Soc., Vol. 37, No. 1/2 1989 January/February p. 40, which refers to work of Schroeder using interaural crosstalk elimination to play binaural recordings made in actual concert halls. Reference is also made to papers of M. R. Schroeder et al. entitled "Comparative study of European concert halls: correlation of subjective preference with geometric and acoustic parameters" in J. Acoust. Soc. Am., Vol. 56, No. 4, October 1974 p. 1195, of Moller entitled "Reproduction of Artificial-Head Recordings through Loudspeakers" in J. Audio Eng. Soc., Vol. 37 No. 1/2 1989 January/February p. 30, of Cooper et al. entitled "Prospects for Transaural Recording" in J. Audio Eng. Soc. Vol. 37, No. 1/2, 1989 January/February p. 3, U.S. Pat.No. 3,236,949 entitled APPARENT SOUND SOURCE TRANSLATOR, and the letter of Salava entitled "Transaural Stereo and Near-Field Listening" in J. Audio Eng. Soc., Vol. 38, No. 1/2 1990 January/February p. 40.

It is an important object of this invention to provide improved apparatus and techniques for transducing binaurally encoded signals into near-field reproduction.

It is another object of the invention to implement the preceding object in a compact, transportable form that can be easily set-up to operate in any environment.

According to the invention, a transportable sound reproduction system for transducing binaurally encoded signals with near-field reproduction comprises a head locator for positioning a listener's head at a desired location in the near-field and a pair of speakers. The speakers are mounted such that they are located close to and forward of the desired location of the listener's head in fixed relationship to the head locator for establishing the near field. The head locator may be mounted upon a bass enclosure. The speakers may be detachably mounted upon the bass enclosure. The head locator and pair of speakers are constructed and arranged so that when reproducing binaurally and transaurally encoded signals simulating an actual sound field, auditory illusions are created at the desired location that are nearly indistinguishable from the listening experience a listener would receive in the actual sound field being simulated. The binaurally encoded signals may be transaurally encoded, using encoding methods known in the art to provide a source of binaurily and transaurally encoded signals simulating an actual sound field.

According to one aspect of the invention, the head locator is a chin rest. According to another aspect of the invention, each speaker is detachably mounted to the bass enclosure by an arm. The arms are constructed having a length and arranged having a position and angular orientation relative to the bass enclosure to always position the speakers at a desired location relative to the location of the listener.

According to another aspect of the invention, each of the speakers further includes a connector which plugs into one of the corresponding jacks located on the external surface of the bass enclosure.

According to another aspect of the invention, the bass enclosure contains equalization circuitry, a power amp, and a woofer, the output of the bass enclosure being located about 4 inches in front of the desired location of the listener's head.

In an exemplary embodiment of the invention, a kit is provided for the transportable sound reproduction system. The kit includes a carrying case having a handle and protective packaging with compartments for detachably securing the bass enclosure, head locator, and speakers. According to one aspect of the exemplary embodiment of the invention, the kit further includes compartments in the protective packaging for detachably securing the arms.

Numerous other features, objects and advantages of the invention will become apparent from the following specification when read in connection with the accompanying drawings in which.

Figure 1:
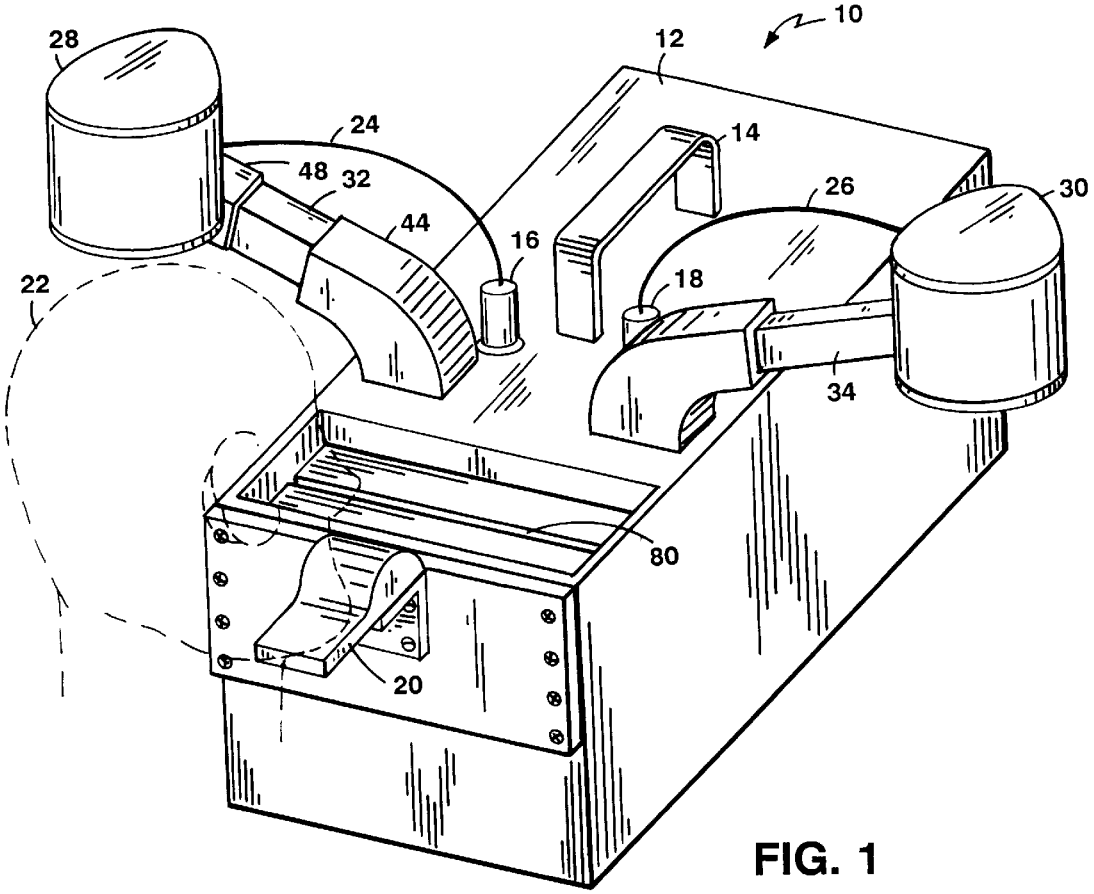
FIG. 1 is a perspective view of a transportable sound reproduction system according to the invention.

With reference now to the drawings and more particularly FIG. 1 thereof, there is shown a perspective view of an embodiment of the invention comprising a transportable sound reproduction system 10 for transducing binaurally encoded signals with near-field reproduction.

System 10 includes a bass enclosure 12 having a carrying handle 14 and a pair of jacks 16, 18. A head locator, e.g., chin rest 20, is mounted to bass enclosure 12 and used for positioning listener's head 22 at a desired location in the near-field. Connectors 24, 26 run from jacks 16, 18 to speakers 28, 30. Speakers 28, 30 are detachably mounted to bass enclosure 12 by arms 32, 34 such that the speakers are located close to and forward of the desired location of listener's head 22.

Arms 32, 34 are constructed having a length, e.g., 8 inches, and arranged having a position and angular orientation relative to bass enclosure 12 to always position speakers 28, 30 at a desired location relative to the listener location, e.g., about 7 inches in front and to the side of and about level with the listener's ears.

Bass enclosure 12 is formed with a slotted port 80 and generally conforms to the commercially available Bose AM-3 woofer enclosure. Bass enclosure 12 has four rubber or plastic feet, such as 81, to help prevent it from vibrating.

Figure 2:
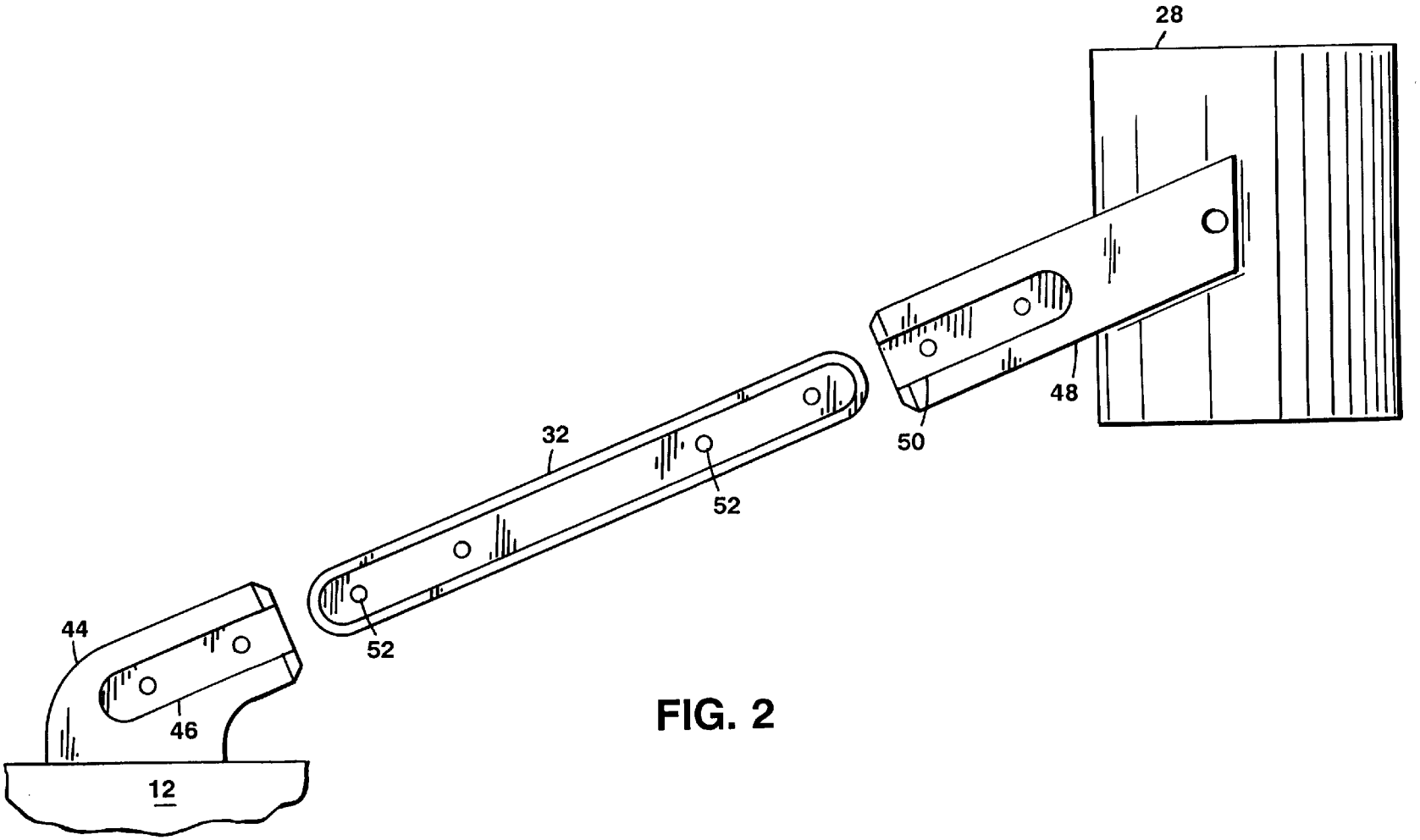
FIG. 2 is an exploded side view showing the connection of an arm to the bass enclosure and a speaker.

Referring to FIG. 2, there is shown an exploded view of the connection of arm 32 to bass enclosure 12 and speaker 28. Bass enclosure 12 includes an integral mounting bracket 44 having slot 46 for receiving arm 32. Speaker 28 has a similar integral mounting bracket 48 having slot 50 for receiving arm 32. Arm 32 is slid into slots 46, 50 and held in place by tightening thumb knobs 52.

Figure 3B:
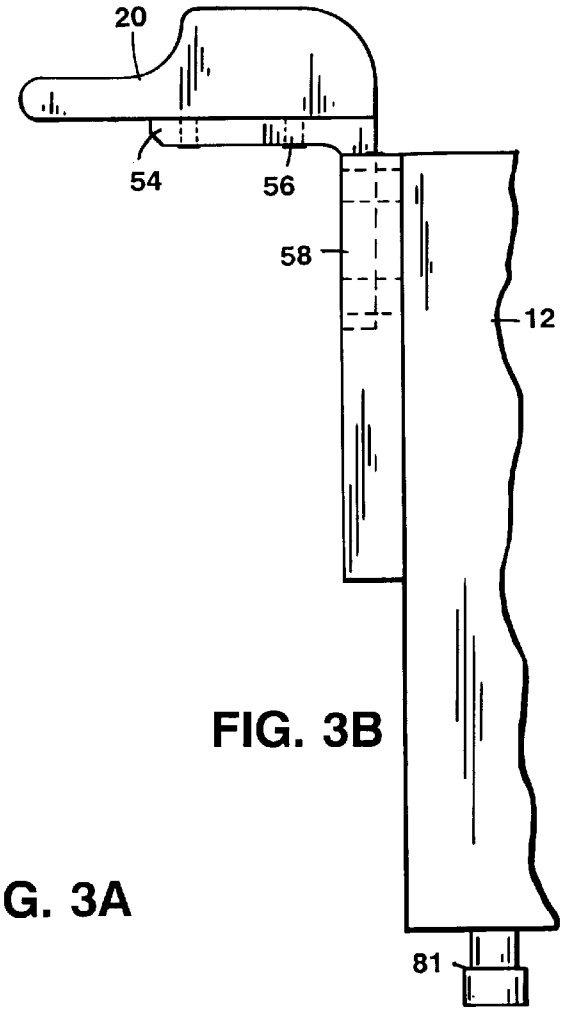
FIGS. 3A and 3B are end and side views of the connection of the chin support to the bass enclosure.
Figure 3A:
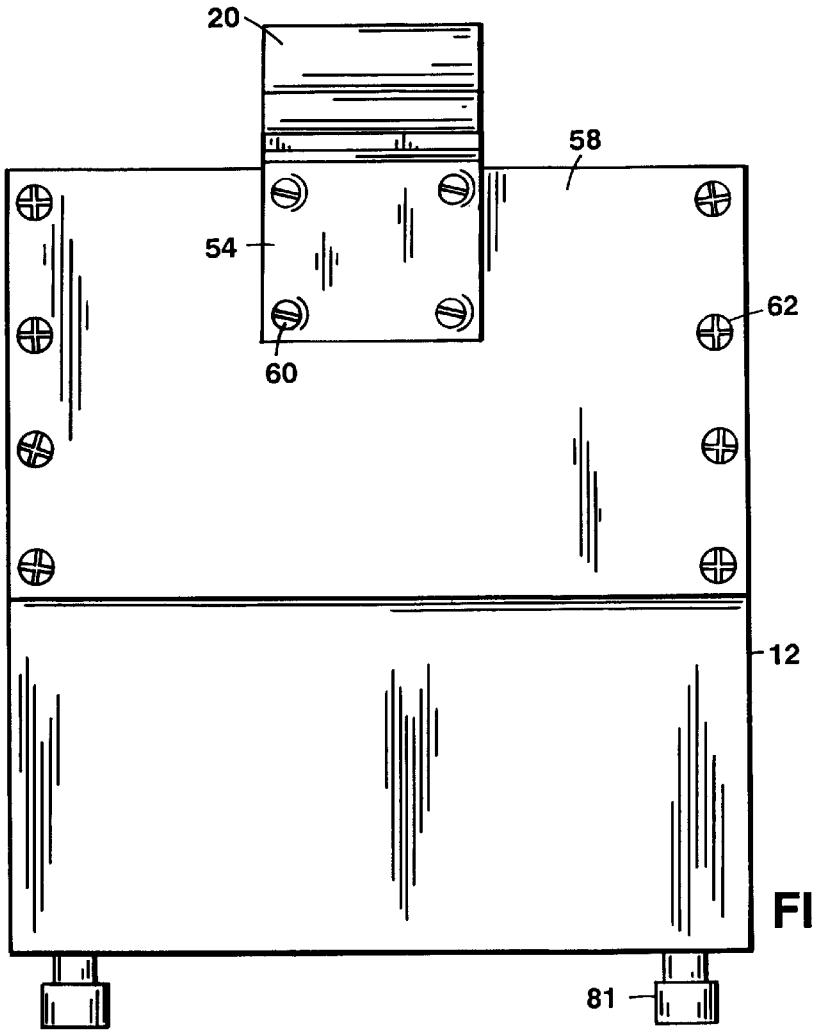

Referring to FIGS. 3A and 3B, there is shown the attachment of chin rest 20 to bass enclosure 12. Chin rest 20 is attached to chin bracket 54 by screws 56. Chin bracket 54 is in turn attached to mounting plate 58 by screws 60. The whole assembly is then attached to bass enclosure 12 by screws 62.

Figure 4:
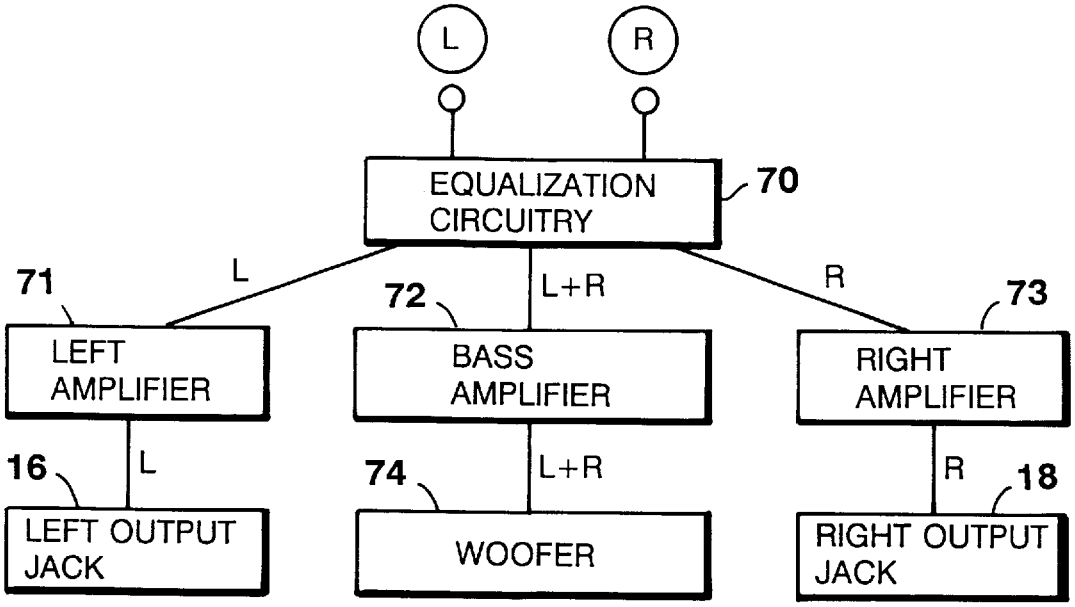
FIG. 4 is a block diagram of some of the components housed within the bass enclosure.

Referring to FIG. 4, bass enclosure 12 contains equalization circuitry 70 that energizes left, bass and right amplifiers 71, 72 and 73, respectively. Left and right amplifiers 71 and 73 have output jacks 16 and 18, respectively. The output of bass amplifier 72 energizes woofer driver 74. The port 80 (FIG. 1) of bass enclosure 12 is located about 4 inches in front of the desired location of listener's head 22. The circuitry in FIG. 4 may be regarded as including processing circuitry coupling the binaurily and transaurally encoded signals to the speakers.

Figure 5A:
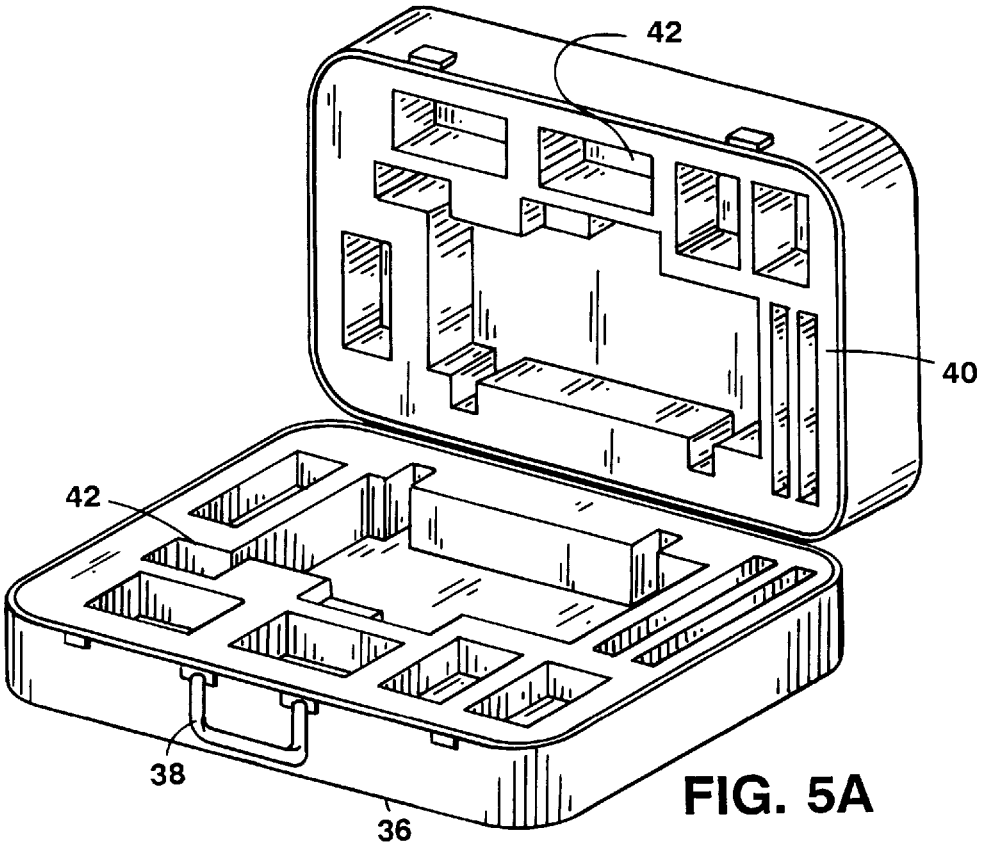
FIGS. 5A and 5B are diagrammatical representations of a carrying case shown open and closed.
Figure 5B:
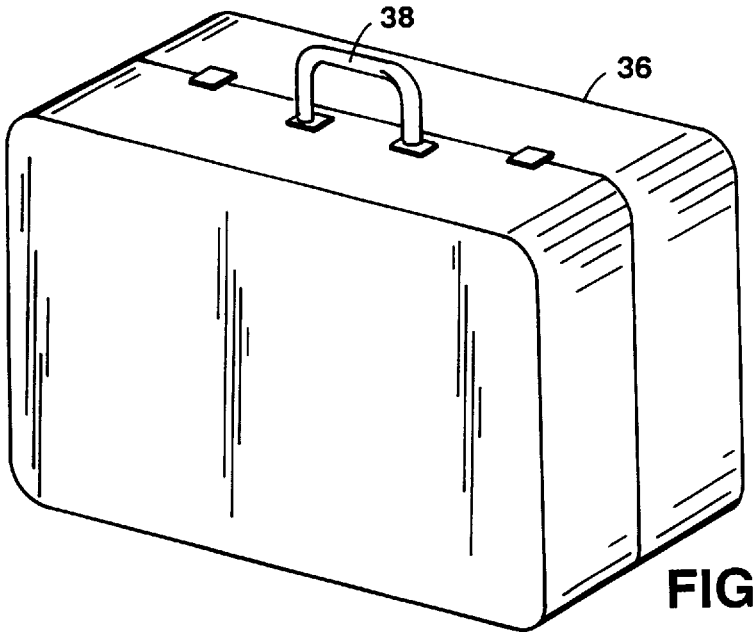

Referring to FIGS. 5A and 5B, there is shown carrying case 36 for packaging transportable sound reproduction system 10 as a kit. Carrying case 36 includes handle 38 for ease of carrying and protective packaging 40 having compartments 42 for detachably securing bass enclosure 12, head locator 20, speakers 28, 30, and arms 32, 34.

Figure 6:
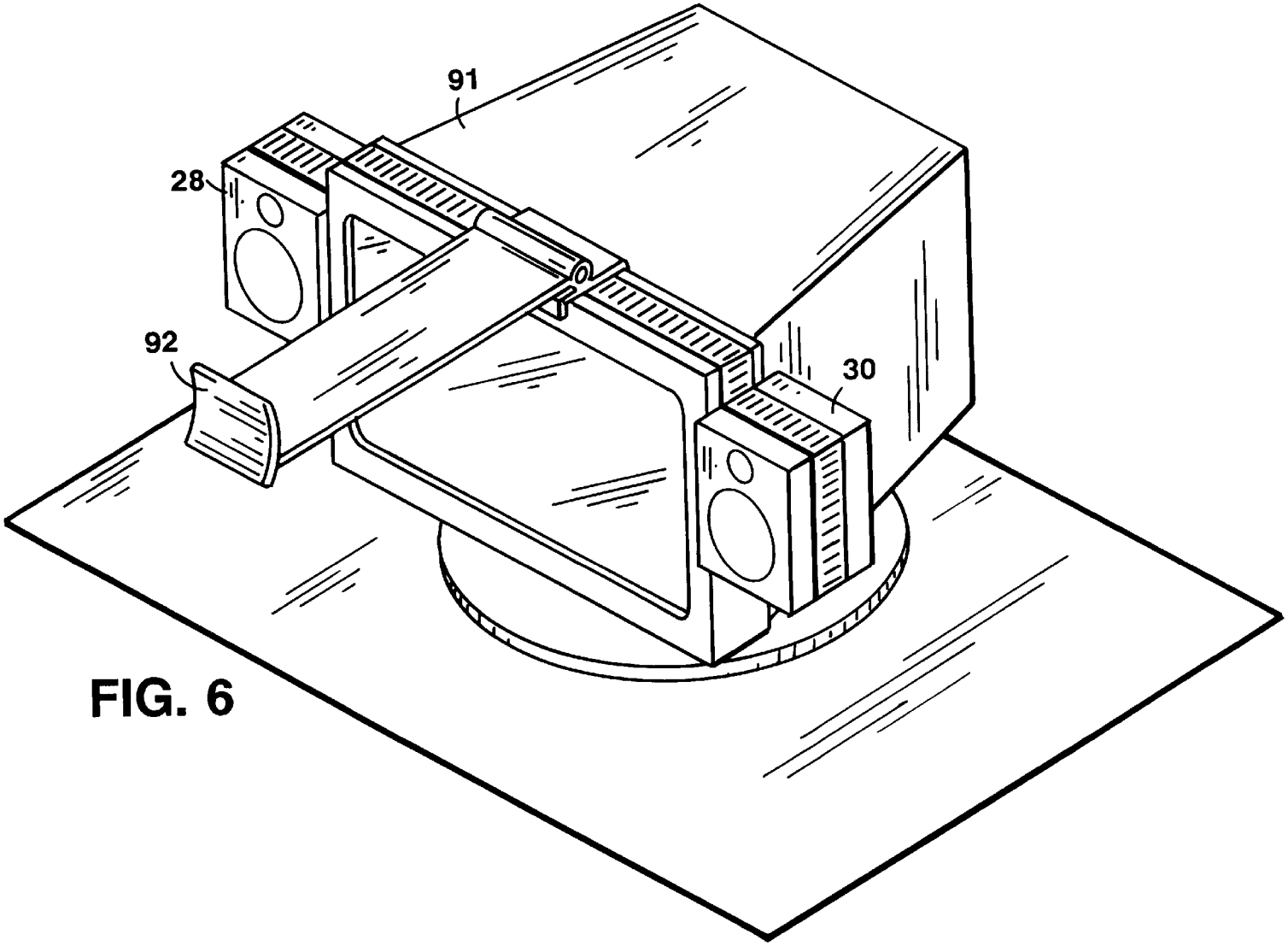
FIGS. 6–8 are diagrammatical representations of alternate embodiments of the invention with different forms of head locators.
Figure 7:
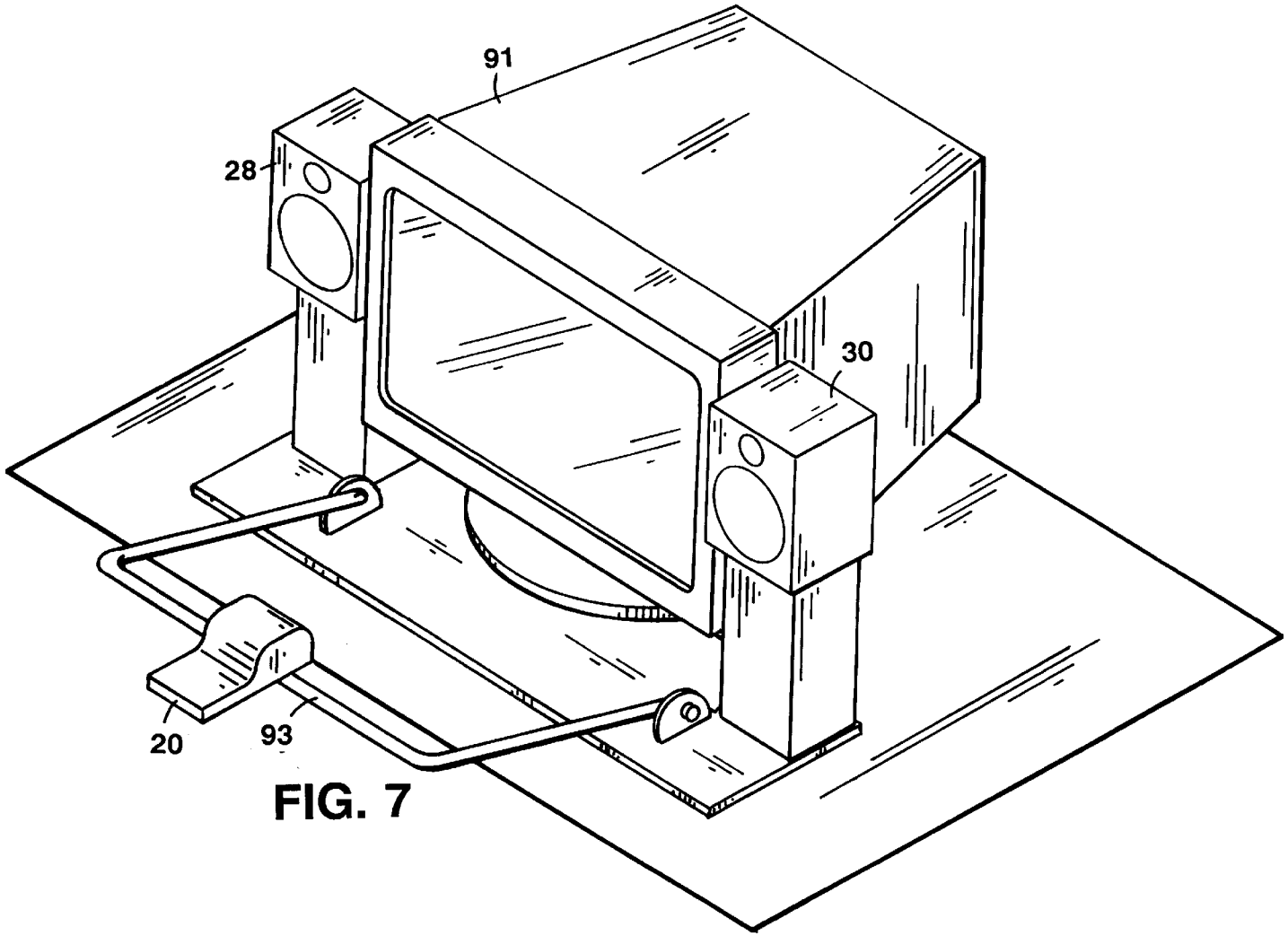
Figure 8:
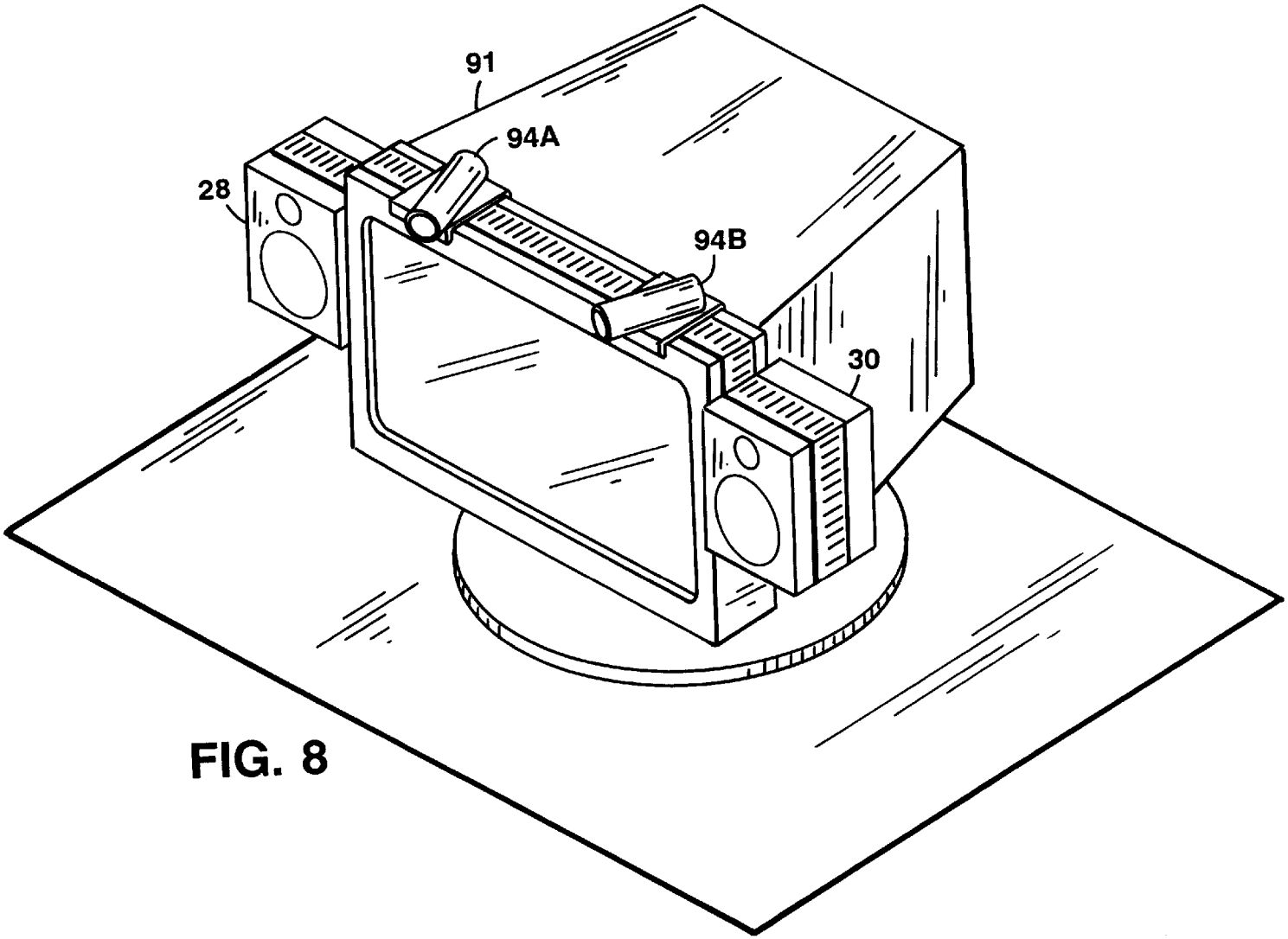

Referring to FIGS. 6–8, there are shown alternative embodiments of the invention with speakers 28 and 30 attached to a video monitor 91 showing different head locators. FIG. 6 shows a padded forehead rest 92 hingably supported from the top of monitor 91 so that it can swing up and back upon the top of the monitor when not listening.

FIG. 7 shows a chin rest 20' mounted upon a hinged base plate bracket 93.

FIG. 8 shows a pair of angled sight tubes 94A and 94B oriented so that when the listener has a clear view through both tubes simultaneously, the head is correctly located.

The head locators need not be attached to a monitor, but might alternatively attached to the bass enclosure, or other suitable transportable supporting structure.

The invention has a number of advantages. It can be used virtually anywhere without the acoustics of the playback environment compromising the quality of the auditory illusion. It is transportable. It is relatively comfortable and hygienic. The listener may easily enter and exit the desired listening region. The head locator furnishes tactile or optical feedback to indicate the correct listening position. The invention may be rapidly and correctly assembled and disassembled. The speaker support arms may be keyed to assure proper location of the left and right speakers. The invention may reproduce sound at relatively high sound levels perceived by the listener at the desired location while perceived at significantly lower sound levels outside the desired location.

When reproducing binaurally encoded signals, it creates a three dimensional auditory illusion that is more realistic than the illusions produced by headphones or by far-field loudspeakers. When binaurally encoded signals are also transaurally encoded before being reproduced by the invention, using encoding methods known in the art, the invention can create auditory illusions that are nearly indistinguishable from the listening experience the listener would receive in the actual sound field being simulated.

Other embodiments are within the claims.

What is claimed is:

1. A transportable sound reproduction system for transducing binaurally encoded signals into near-field reproduction comprising, a head locator for positioning a listener's head at a desired location in said near-field, and a pair of speakers for establishing said near-field in fixed relation to said head locator such that said speakers are located close to and forward of the desired location of said listener's head, a source of binaurally, and transaurally encoded signals simulating an actual sound field, processing circuitry coupling said source of binaurally and transaurally encoded signals to said pair of speakers, said head locator and said pair of speakers constructed and arranged so that when reproducing binaurally and transaurally encoded signals simulating an actual sound field, auditory illusions are created at said desired location that are nearly indistinguishable from the listening experience a listener would receive in the actual sound field being simulated.

2. The transportable sound reproduction system in accordance with claim 1 wherein said head locator comprises a chin rest.

3. A transportable sound reproduction system in accordance with claim 1 wherein said listener's head has ears and said speakers are located at desired locations about seven inches to the front and to the side of and about level with said ears.

4. A transportable sound reproduction system for transducing binaurally encoded signals into near-field reproduction in accordance with claim 1 and further comprising a source of said binaurally and transaurally encoded signals coupled to said pair of speakers.

5. The transportable sound reproduction system in accordance with claim 1 and further comprising a transportable support, wherein said speakers are detachably mounted by a pair of arms, each of said arms for mounting one of said speakers to said support.

6. The transportable sound reproduction system in accordance with claim 5 wherein said arms are constructed having a length and arranged having a position and angular orientation relative to said support to always position said speakers at a predetermined location relative to said desired location.

7. The transportable sound reproduction system in accordance with claim 6 wherein said support comprises a bass enclosure.

8. The transportable sound reproduction system in accordance with claim 7 wherein said bass enclosure has a pair of output connectors and each of said speakers further includes an input connector for detachably electrically connecting a respective speaker to a respective one of said output connectors.

9. The transportable sound reproduction system in accordance with claim 7 wherein said bass enclosure contains equalization circuitry, power amplifying circuitry, and at least a loudspeaker driver.

10. The transportable sound reproduction system in accordance with claim 7 wherein said bass enclosure has an acoustic output located about four inches before said desired location.

11. A kit for a transportable sound reproduction system for transducing binaurally encoded signals with near-field reproduction comprising, a pair of speakers, a speaker support for supporting said pair of speakers, carrying case, said case including protective packaging with compartments for detachably securing said speaker support, and a head locator for positioning a listener's head at a desired location, a source of binaurally and transaurally encoded signals simulating an actual sound field processing circuitry coupling said source of binaurally and transaurally encoded signals to said pair of speakers, said head locator, said speaker support and said pair of speakers when assembled constructed and arranged so that when reproducing binaurally and transaurally encoded signals simulating an actual sound field, auditory illusions are created at said desired location that are nearly indistinguishable from the listening experience a listener would receive in the actual sound field being simulated.

12. The kit for a transportable sound reproduction system in accordance with claim 11 and further comprising compartments in said protective packaging for accommodating a pair of arms, each of said arms for detachably securing a respective one of said speakers to said speaker support.

13. A kit for a transportable sound reproduction system in accordance with claim 11 wherein each of said arms is of the order of eight inches and said support is constructed and arranged to coact with said arms to mount said speakers at desired locations relative to a desired location of a listener's head having ears and established by said head locator about seven inches to the front and to the side of and about level with said ears.

* * * * *